US009242363B2

(12) United States Patent
Moessnang et al.

(10) Patent No.: US 9,242,363 B2
(45) Date of Patent: Jan. 26, 2016

(54) SIDE HANDLE FOR A HAND-HELD POWER TOOL

(75) Inventors: Franz Moessnang, Landsberg (DE); Markus Hartmann, Mauerstetten (DE); Michael Kurz, Karlsruhe (DE)

(73) Assignee: Hilti Aktiengesellschaft, Schaan (LI)

( * ) Notice: Subject to any disclaimer, the term of this patent is extended or adjusted under 35 U.S.C. 154(b) by 780 days.

(21) Appl. No.: 12/798,970

(22) Filed: Apr. 15, 2010

(65) Prior Publication Data

US 2010/0282484 A1 Nov. 11, 2010

(30) Foreign Application Priority Data

Apr. 17, 2009 (DE) ..... 10 2009 002 463

(51) Int. Cl.

| | |
|---|---|
| ***B25D 17/00*** | (2006.01) |
| ***B25F 5/00*** | (2006.01) |
| ***B25D 17/04*** | (2006.01) |
| ***B25F 5/02*** | (2006.01) |

(52) U.S. Cl.

CPC ..... *B25F 5/006* (2013.01); *B25D 17/043* (2013.01); *B25F 5/026* (2013.01); *B25D 2217/0092* (2013.01); *B25D 2250/245* (2013.01); *Y10T 16/466* (2015.01)

(58) Field of Classification Search

CPC ..... B25F 5/026; B25F 5/02; B25D 17/043
USPC ..... 173/162.1–162.2; 16/421
See application file for complete search history.

(56) References Cited

U.S. PATENT DOCUMENTS

| | | | | |
|---|---|---|---|---|
| 3,322,211 | A * | 5/1967 | Alabuzhev et al. | 173/162.2 |
| 4,368,556 | A * | 1/1983 | Wanner et al. | 16/436 |
| 4,371,043 | A * | 2/1983 | Kubokawa | 173/162.2 |
| 4,401,167 | A * | 8/1983 | Sekizawa et al. | 173/162.1 |
| 4,611,671 | A * | 9/1986 | Hansson | 173/162.2 |
| 4,819,742 | A * | 4/1989 | Driggers | B25F 5/006 173/162.2 |
| 5,025,870 | A * | 6/1991 | Gantner | B25D 17/043 173/162.1 |
| 5,157,807 | A | 10/1992 | Keller et al. | 16/116 R |
| 5,273,120 | A * | 12/1993 | Chang | 173/162.2 |
| 5,365,637 | A * | 11/1994 | Bodell et al. | 16/431 |
| 6,148,930 | A * | 11/2000 | Berger et al. | 173/162.2 |
| 7,137,542 | B2 * | 11/2006 | Oki et al. | 173/162.2 |
| 7,252,156 | B2 * | 8/2007 | Sugiyama et al. | 173/162.1 |
| 7,676,890 | B2 * | 3/2010 | Zhang et al. | 16/431 |
| 7,708,260 | B2 * | 5/2010 | Eicher et al. | 267/207 |
| 7,721,390 | B2 * | 5/2010 | Pfeiffer et al. | 16/426 |
| 7,886,839 | B2 * | 2/2011 | Frauhammer | B25D 17/043 173/162.1 |
| 7,921,935 | B2 * | 4/2011 | Engelfried et al. | 173/162.2 |
| 8,235,136 | B2 * | 8/2012 | Berger | B25B 11/005 173/109 |

(Continued)

FOREIGN PATENT DOCUMENTS

| | | |
|---|---|---|
| EP | 1 514 648 A2 | 3/2005 |
| EP | 1 905 546 A2 | 4/2008 |

(Continued)

*Primary Examiner* — Robert Long
(74) *Attorney, Agent, or Firm* — Davidson, Davidson & Kappel, LLC

(57) ABSTRACT

A side-handle for a hand-held power tool includes a gripping element and a fastener for fastening the side handle to the hand-held power tool. The gripping element and the fastening means can be pivoted with respect to each other around a rotational axis. This rotational axis runs perpendicular to a longitudinal axis of the gripping element and runs through an end area of the gripping element facing away from the fastener.

6 Claims, 3 Drawing Sheets

(56) References Cited

U.S. PATENT DOCUMENTS

| | | | | |
|---|---|---|---|---|
| 8,342,705 | B2 * | 1/2013 | Yaksich | B25F 5/021 362/109 |
| 2002/0197939 | A1 * | 12/2002 | Frauhammer | B25D 17/043 451/64 |
| 2003/0006051 | A1 * | 1/2003 | Schmitzer | B25D 17/043 173/49 |
| 2005/0082072 | A1 * | 4/2005 | Nicolantonio | B25F 5/026 173/162.2 |
| 2005/0087353 | A1 * | 4/2005 | Oki et al. | 173/162.2 |
| 2006/0219419 | A1 * | 10/2006 | Sugiyama et al. | 173/162.2 |
| 2007/0089274 | A1 | 4/2007 | Zhang et al. | 16/431 |
| 2008/0202785 | A1 * | 8/2008 | Fischer | B25D 17/24 173/162.2 |
| 2008/0223593 | A1 * | 9/2008 | Eicher et al. | 173/162.2 |
| 2008/0235913 | A1 * | 10/2008 | Eicher et al. | 16/430 |
| 2009/0038121 | A1 * | 2/2009 | Eicher et al. | 16/426 |
| 2009/0038818 | A1 * | 2/2009 | Eicher et al. | 173/162.2 |
| 2009/0133544 | A1 * | 5/2009 | Hofbrucker | B25F 5/003 81/489 |
| 2010/0064860 | A1 * | 3/2010 | Kozak | B23B 45/005 81/177.6 |
| 2010/0206595 | A1 * | 8/2010 | Kamegai | 173/162.2 |
| 2011/0011609 | A1 * | 1/2011 | Simm | B25D 17/04 173/171 |
| 2011/0100665 | A1 * | 5/2011 | Nakashima | B23D 51/01 173/162.2 |
| 2011/0114345 | A1 * | 5/2011 | Schlesak | B23Q 11/0092 173/1 |
| 2012/0125164 | A1 * | 5/2012 | Kozak | B23B 45/005 81/177.6 |
| 2014/0144656 | A1 * | 5/2014 | Roehm | B25F 5/026 173/46 |
| 2015/0144368 | A1 * | 5/2015 | Machida | B25F 5/006 173/162.2 |

FOREIGN PATENT DOCUMENTS

| | | | | |
|---|---|---|---|---|
| GB | 2 080 920 | A | 2/1982 | |
| GB | 2080920 | A * | 2/1982 | F16F 7/10 |
| GB | 2 451 745 | A | 2/2009 | |
| WO | WO 2007115845 | A1 * | 10/2007 | B25D 17/04 |
| WO | WO 2009/089961 | A1 | 7/2009 | |

* cited by examiner

SIDE HANDLE FOR A HAND-HELD POWER TOOL

This claims the benefit of German Patent Application DE 10 2009 002 463.8, filed Apr. 17, 2009 and hereby incorporated by reference herein.

The invention relates to a side handle for a hand-held power tool.

BACKGROUND

Hand-held power tools transmit vibrations to a side handle. Damping elements in the side handle serve to reduce the amplitude of the vibrations on a gripping surface. U.S. Pat. No. 5,157,807 A describes such a handle.

The vibration-damping side handle is a compromise between the ability to transmit forces from the user to the hand-held power tool and the ability to reduce vibrations caused by the hand-held power tool on the gripping surface. The transmission of forces calls for stiff, unyielding elements. Damping, especially of low-frequency vibrations, requires soft, yielding elements.

As an alternative, the inertia of the side handle can be increased by raising its mass in order to improve the damping. This, however, increases the weight of the hand-held power tool.

SUMMARY OF THE INVENTION

An object of the present invention is to provide a side handle entailing an improved compromise between the transmission of forces and the reduction of vibrations.

The present invention provides a side handle for a hand-held power tool, a gripping element and a fastening means or device for fastening the side handle to the hand-held power tool. The gripping element and the fastening means can be pivoted with respect to each other around a rotational axis. This rotational axis runs perpendicular to a longitudinal axis of the gripping element and runs through an end area of the gripping element facing away from the fastening means.

The user can grip the gripping element near its end area. The forces that the user exerts perpendicular to the gripping element are transmitted to the fastening means. Vibrations introduced via the fastening means cause the gripping element to oscillate. The amplitude of the vibrations is converted into an oscillatory movement and its energy is dissipated and/or the amplitude is once again released with a phase shift relative to the vibrations.

One embodiment provides for an end area of the gripping element facing the fastening means to have a return element to drive the gripping element back into a basic position relative to the fastening means. The return element can be harmonized with the frequencies of the vibrations that occur, so that the side handle functions as an active mass damper. An active mass damper is resonantly excited by the vibrations, and once again releases the vibrations with a phase shift relative to the newly occurring vibrations, thus destructively.

One embodiment provides for the gripping element to be a bearing that defines the rotational axis around which the gripping element can be pivoted, and for a connection element to connect the bearing to the fastening means. The connection element can be rigid. Preferably, the connection element is arranged inside the gripping bar.

One embodiment provides for the bearing to have at least one elastic element that couples the connection element to the gripping element. The described bearing can have a simpler construction in comparison to a sliding bearing with precisely fitting bearing elements. The elastic element can encircle the connection element like a ring.

One embodiment provides for the bearing to be formed by a solid joint in the connecting bar. This reduces the number of elements needed, as a result of which the side handle can be assembled more easily.

One embodiment provides for a return element to be installed on an end area of the gripping element facing the fastening means, said return element engaging with the connection element and with the gripping element. The return element can be formed by a spring. The return element can be formed by a helical spring or a spiral spring that, with a first surface of a first coil, is in contact with the gripping element and which, with a second surface of a second coil, is in contact with the connection element. The second surface can face away from the connection element.

One embodiment provides for an additional mass to be installed on an end area of the gripping element facing the fastening means. This additional mass increases the torque of the oscillating gripping element. The lever action achieves a substantial effect already with a relatively small weight.

One embodiment provides for the center of gravity of the gripping element to be outside of a prescribed gripping surface.

BRIEF DESCRIPTION OF THE DRAWINGS

The description below explains the invention on the basis of examples of embodiments and figures. The figures show the following.

Unless otherwise indicated, identical or functionally equivalent elements are labeled with the same reference numerals in the figures.

DETAILED DESCRIPTION

Figure 1:
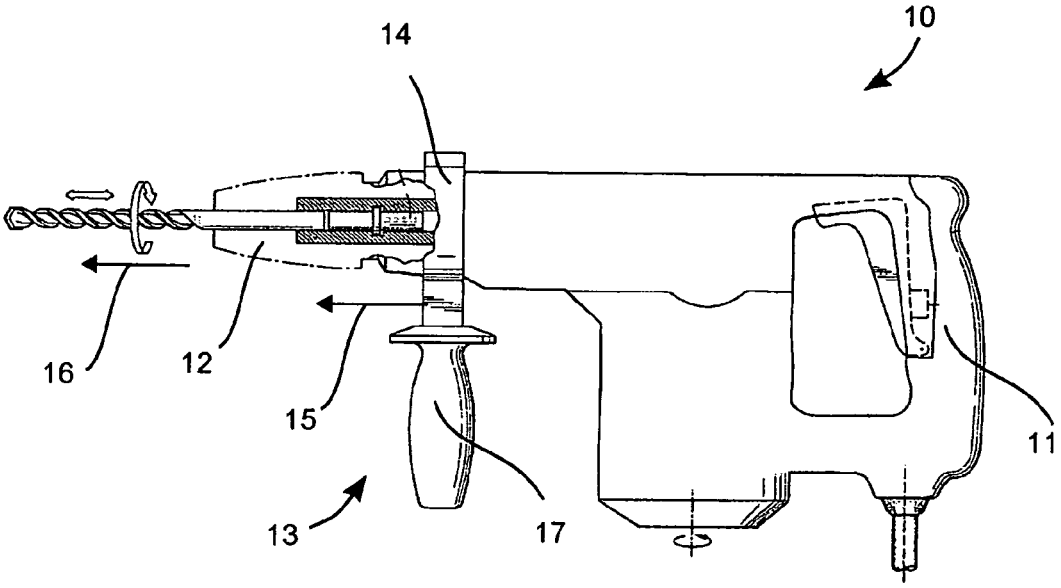
FIG. 1—a hand-held power tool.

FIG. 1 shows a hand-held power tool 10. Instead of the hammer drill shown by way of an example, this hand-held power tool 10 can also be, for instance, a power drill, a chiseling hammer, an electric screwdriver or a disk grinder. The hand-held power tool 10 has a handle 11 and an additional side handle 13 near a tool receptacle 12. The side handle 13 can preferably be detachably fastened to the hand-held power tool 10, for example to a body or housing of the power tool. The side handle 13 makes it easier for users to position the hand-held power tool 10 since they can hold the machine with both hands, especially in the case of heavy hand-held power tools 10.

Figure 2:
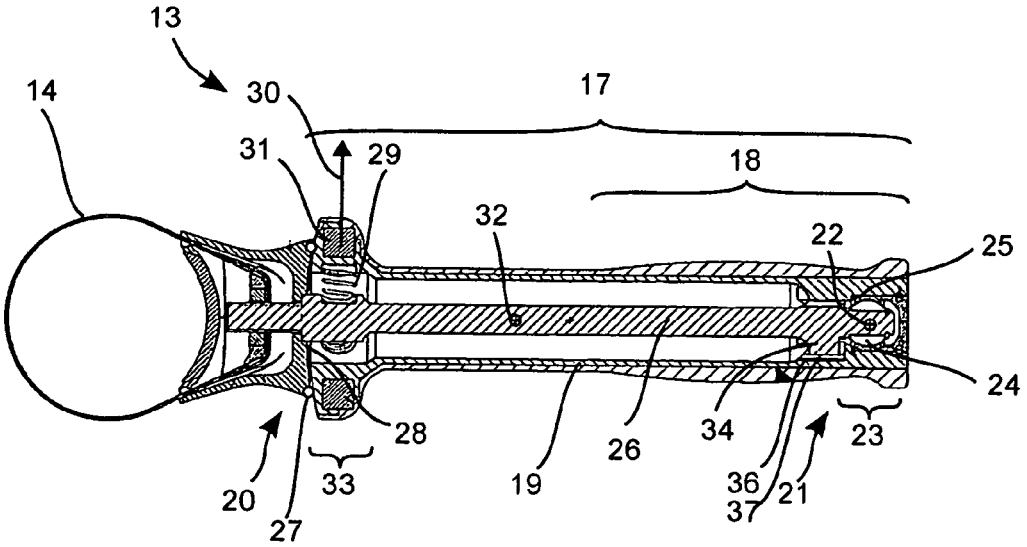
FIG. 2—a side handle.

FIG. 2 shows a cross section of an embodiment of the side handle 13. The side handle 13 has a tightening collar 14 by means of which the side handle 13 can be attached to the hand-held power tool 10. The tightening collar 14 defines the orientation of the side handle 13 along an axis 15. When the side handle 13 is fastened to the hand-held power tool 10, this axis 15 can be parallel to the striking direction or direction of action 16 of the hand-held power tool 10. Instead of the tightening collar 14, the side handle 13 can also be fastened to the hand-held power tool 10 by a screwed connection or by another suitable fastening means.

The side handle 13 comprises a gripping bar 17 with a gripping surface 18. A user can grasp, at least partially, around the gripping surface 18. A plastic that is well tolerated by the skin can be sprayed around the gripping bar 17, thus creating the gripping surface 18. The gripping surface 18 can be shaped to match the anatomical shape of the hand. Consequently, this can create a grip for the thumb and index finger.

The gripping bar 17 can be configured to be hollow like a gripping sleeve 19. The gripping bar 17 is approximately perpendicular to the axis 15. A first end 20 of the gripping bar 17 faces the tightening collar 14, while a second end 21 of the gripping bar 17 faces away from the tightening collar 14.

The gripping bar 17 is mounted so as to pivot with respect to the tightening collar 14 around a rotational axis 22. The rotational axis 22 runs through the second end 21 of the gripping bar 17 and is essentially parallel to the axis 15. A bearing 23, for example, is installed in the gripping bar 17 on the second end 21. The bearing 23 has a first bearing element 24 and a second bearing element 25, both of which can be rotated with respect to each other at least around the rotational axis 22. The first bearing element 24 is joined torsionally stiffly to the gripping bar 17, for example, to the gripping sleeve 19. The second bearing element 25 is joined to the tightening collar 14 via a connecting bar 26. The connecting bar 26 can be made of a stiff material. The connecting bar 26 can be arranged inside the gripping sleeve 19. The first end 22 of the gripping bar 17 is at a such a distance from the tightening collar 14 that the first end 22 can be moved with respect to the tightening collar 14 in a rotational movement around the rotational axis 22. A sealing element 27, for instance, a felt ring or a bellows, can be provided on the tightening collar 14, thus sealing an interstice 28 that is formed between the tightening collar 14 and the first end 20.

A spring 29 is provided on the first end 20 of the gripping bar 17. The spring 29 exerts a force 30 onto the gripping bar 17 essentially along the axis 15 of the connecting bar 26. The spring 29 functions like a return element that drives the gripping bar 17 back into a basic position after the latter has been pivoted with respect to the connecting bar 26. The spring 29 can exert compressive and/or torsional forces. Preferably, the spring 29 is configured such that it does not exert any force if the gripping bar 17 and the connecting bar 26 are positioned parallel to each other.

A mass body 31 can be arranged on the first end 20. The weight of the mass body 31 is selected in such a way that the center of gravity 32 of the gripping bar 17 is outside of the gripping surface 18. The mass body 31 can be integrated inside an anti-slip device 33 on the first end 20.

A deflection of the gripping bar 17 can be prevented by means of stop elements 34. The stop element 34 can be formed, for example, by a projection on the connecting bar 26 or inside the gripping bar 17. The damping can be stopped, for instance, especially when the user pulls the hand-held power tool 10 away from the workpiece. For this purpose, the stop element 34 can be arranged asymmetrically to the axis 15 on one side facing the direction of action 16 of the hand-held power tool 10 when the side handle 13 is fastened to the hand-held power tool 10. An elastic buffer 37 can be arranged on the stop element 34 or on a surface 36 located opposite from the stop element 34.

Figure 3:
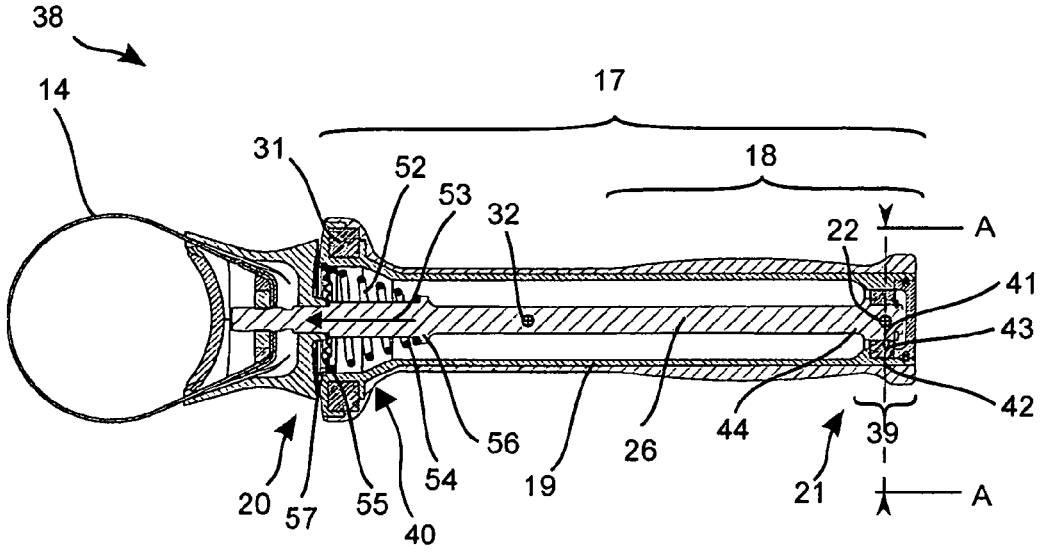
FIG. 3—a further embodiment of a side handle.

FIG. 3 shows another embodiment of a side handle 38. The structure differs from the side handle 13 described in conjunction with FIG. 2, among other things, in terms of the design of the bearing 39 and of the return element 40. The two embodiments can be combined with each other, for instance, by replacing the bearing and/or the return element.

The bearing 39 consists of a first bearing shell 41, a second bearing shell 42 and a spring element 43. The first bearing shell 41 is formed by an end piece 44 of the connecting bar 26. The end piece 44 has a depression 45, for example, a ring-shaped or star-shaped depression 45. The second bearing shell 42 can be formed by an inner contour 46 of the second end 21. The spring element 43 can be formed by elastic elements, for instance, a ring made of an elastic plastic. The spring element(s) engage(s) with the opposing depressions 45, 46 of the two bearing shells 41, 42.

Figure 4:
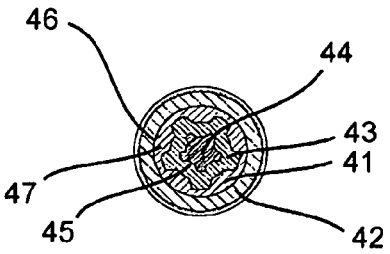
FIG. 4—a section through the side handle from FIG. 3.

FIG. 4 shows a possible embodiment of the elastic element 47 and of the bearing shells 41, 42, in the cross section along the plane A-A from FIG. 3.

Figure 5:
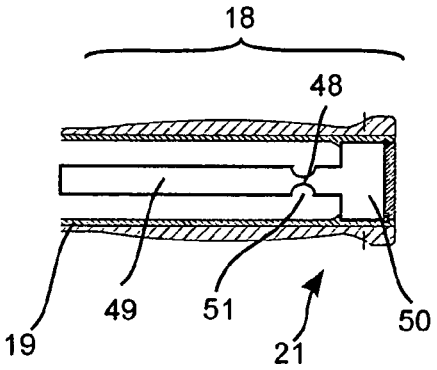
FIG. 5—a detailed view of a side handle.

Another embodiment provides for the bearing to be configured as a solid joint 48. The solid joint 48 is shown in a cross section in FIG. 5. The connecting bar 49 is made of an elastic material. The second end 21 of the gripping bar 17 is positioned positively and/or non-positively on the connecting bar 49 at a connection site 50, for example, by means of a clamped or screwed connection. The connecting bar 49 is configured so as to be thinner in an area 51. The cross section surface in the thinner area 51 is selected in such a way that the connecting bar 49 essentially bends only in this thinner area 51 when forces are exerted. The thinner area 51 is in the area of the second end 21 of the gripping bar 17.

The return element 40 comprises a helical spring 52. A longitudinal axis 53 of the helical spring 52 is co-linear with the connecting bar 26. A surface of the first coil 54 of the helical spring 52 facing the longitudinal axis 53 touches the connecting bar 26. A surface of the second coil 55 of the helical spring 52 facing away from the longitudinal axis 53 touches the gripping bar 17. When the handle 13 is deflected with respect to the connecting bar 26, a shear force is exerted on the helical spring 52. The helical spring 52 counteracts the shear force with a corresponding counterforce. The helical spring 52 can be clamped by means of a first bridge 56 to the connecting bar 26 and by means of a second bridge 57 in the gripping bar 17 along the longitudinal axis 53.

Figure 6:
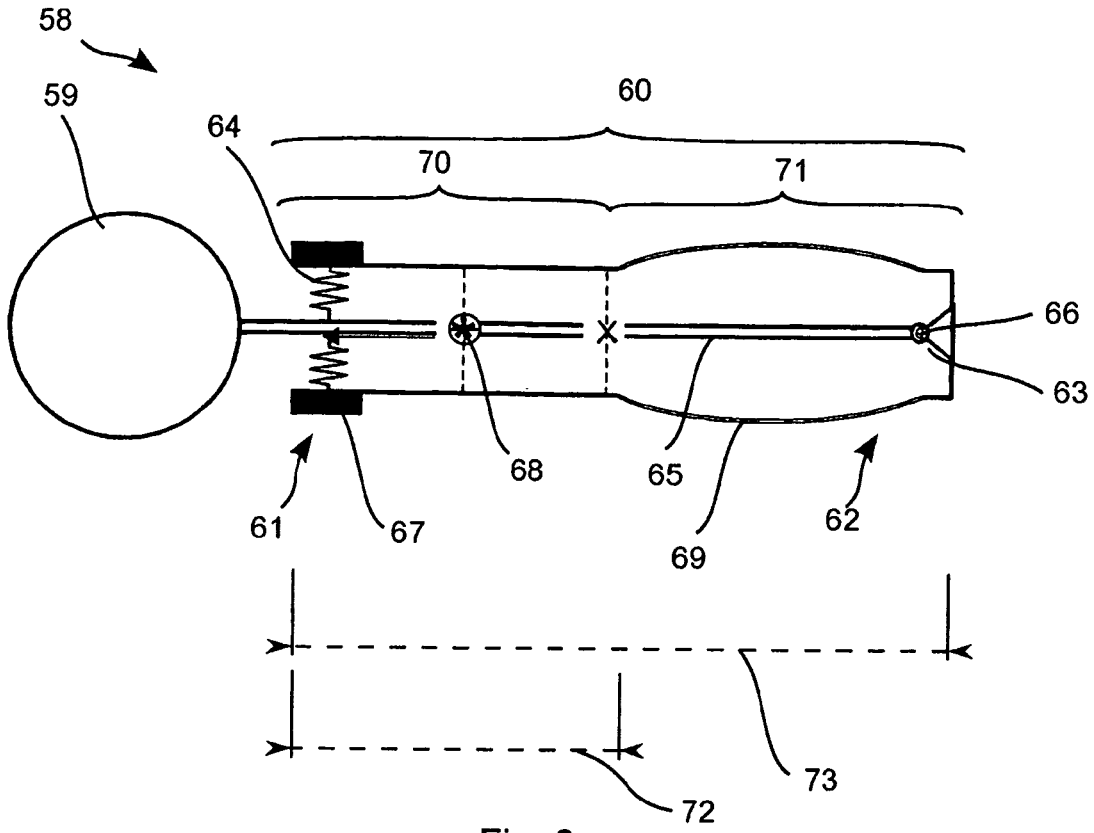
FIG. 6—a schematically depicted side handle.

FIG. 6 schematically shows a side handle 58. This side handle 58 comprises a fastening means or device 59 and a gripping element 60 having a first end 61 and a second end 62. The gripping element 60 encompasses a bearing 63 and a return element 64. The fastening device 59 can be, for instance, a tightening collar. The gripping element 60 is such that a user can hold onto a hand-held power tool 10 by means of said gripping element 60. The first end 61 of the gripping element 60 faces the fastening device 59, while the second end 62 of the gripping element 60 faces away from the fastening device 59. The bearing 63 is arranged in or on the second end 62. A connecting element 65 couples the bearing 63 to the gripping element 60 so that it can rotate around a rotational axis 66 that is oriented essentially perpendicular to the connecting element 65. The rotational axis 66 runs through the second end 62, that is to say, through the bearing 63. The return element 64 is arranged in or on the first end 61. The return element 64 exerts a force onto the first end 61 when it is deflected relative to the connecting element 65.

The gripping element 60 can have an additional mass 67 on the first end 61. Owing to this additional mass 67, the center of gravity 68 of the gripping element 60 is outside of a prescribed gripping area 69 of the gripping element 60 provided for the user to grasp. gripping purposes. The outer contour of the gripping element is divided into an inner area 70 and a gripping surface 71. The inner area 70 can form the first end 61. The length 72 of the inner area 70 can be less than 50 percent, preferably less than 25 percent, of a total length 73 of the gripping element. The weight of the additional mass 67 is selected in such a way that the center of gravity 68 is within the inner area 70. The first weight m of the additional mass 67 can be chosen as a function of the second weight M of the entire gripping element 60. The ratio of the first weight m to the second weight M can be at least 0.2 and at most 1.0, for instance, at least 0.5.

What is claimed is:

1. A side handle for a hand-held power tool, comprising:

a gripping element; and a fastener for fastening the side handle to the hand-held power tool, the gripping element and the fastener pilotable with respect to each other around a rotational axis, the rotational axis running perpendicular to a longitudinal axis of the gripping element and running through an end area of the gripping element facing away from the fastener, wherein the gripping element has a bearing defining the rotational axis around which the gripping element can be pivoted, a stiff connecting bar connecting the bearing to the fastener, the connecting bar being connected to the bearing at one end of the connecting bar and to the fastener at another end of the connecting bar, the bearing having at least one elastic element at the one end coupling the connecting bar connector to the gripping element wherein a further end area of the gripping element facing the fastener has a return element to drive the gripping element back into a basic position relative to the fastener;

wherein the return element is formed by a helical spring or a spiral spring that, with a first surface of a first coil, is in contact with the gripping element and which, with a second surface of a second coil, is in contact with the connecting bar.

2. The side handle as recited in claim 1 wherein the second surface faces away from the connecting bar.

3. The side handle as recited in claim 1 wherein the helical spring winds coaxially around the connecting bar.

4. A side handle for a hand-held power tool, comprising:

a gripping element; and a fastener for fastening the side handle to the hand-held power tool, the gripping element and the fastener pivotable with respect to each other around a rotational axis, the rotational axis running perpendicular to a longitudinal axis of the gripping element and running through an end area of the gripping element facing away from the fastener, the gripping element having a bearing defining the rotational axis around which the gripping element can be pivoted, the bearing and the fastener defining a first axis therebetween the longitudinal axis of the gripping elem de first axis, a connector connecting the bearing to the fastener, a further end area of the gripping element facing the fastener having a return element to drive the gripping element back into a basic position relative to the fastener, the return element being located within the gripping element and extending from the connector to an interior surface of the gripping element.

5. The side handle as recited in claim 4 wherein the connector is a connecting bar running between the bearing and the fastener entirely along the first axis.

6. The hand-held power tool as recited in claim 1 wherein the body has a handle and a tool receptacle, the side handle being closer to the tool receptacle than the handle is to the tool receptacle.

* * * * *